United States Patent [19]

Iyer et al.

[11] Patent Number: 4,766,274

[45] Date of Patent: Aug. 23, 1988

[54] VACUUM CIRCUIT INTERRUPTER CONTACTS CONTAINING CHROMIUM DISPERSIONS

[75] Inventors: Natraj C. Iyer, Monroeville; Alan T. Male, Murrysville Borough, both of Pa.; Sidney J. Cherry, Elmira, N.Y.; Robert E. Gainer, Monroeville Boro., Pa.

[73] Assignee: Westinghouse Electric Corp., Pittsburgh, Pa.

[21] Appl. No.: 147,420

[22] Filed: Jan. 25, 1988

[51] Int. Cl.[4] ..... H01H 33/66

[52] U.S. Cl. ..... 200/144 B; 200/265; 75/200; 75/247; 419/32

[58] Field of Search ..... 200/144 B, 265; 75/200

[56] References Cited

U.S. PATENT DOCUMENTS

| | | | |
|---|---|---|---|
| 3,683,139 | 8/1972 | Ludwig | 200/144 B |
| 3,818,163 | 6/1974 | Robinson | 200/144 B |
| 3,960,554 | 6/1976 | Gainer, Jr. | 75/200 |
| 4,008,081 | 2/1977 | Hundstad | 75/135 |
| 4,032,301 | 6/1977 | Hassler et al. | 200/265 |
| 4,048,117 | 9/1977 | Emmerich | 200/265 |
| 4,190,753 | 2/1980 | Gainer | 200/144 B |
| 4,259,270 | 3/1981 | Winter et al. | 264/8 |
| 4,302,514 | 11/1981 | Kato et al. | 428/569 |
| 4,323,590 | 4/1982 | Lipperts | 200/144 B |
| 4,419,551 | 12/1983 | Kato | 200/144 B |
| 4,640,999 | 2/1987 | Kashiwagi et al. | 200/144 B |
| 4,677,264 | 6/1987 | Okumura et al. | 200/144 B |

OTHER PUBLICATIONS

Hansen—Constitution of Binary Alloys, McGraw Hill Book Co.

*Primary Examiner*—Robert S. Macon
*Attorney, Agent, or Firm*—B. K. Niyogi

[57] ABSTRACT

A powdered metallurgical procedure for forming chromium copper contacts used in vacuum circuit interrupters, in which prealloyed powder formed by mixing to copper, chromium of between two to thirty-seven weight percent is rapidly solidified after melting at about 1100° C. to 1500° C. This powder may be blended with additional chromium of between 12 to 50 weight percent with a maximum of fifty-five weight percent of chromium in the final contact structure. This blended mixture may then be either (i) cold pressed at 100,000 psig. and vacuum sintered at 800° to 1400° C.; or (ii) be subjected to hot isostatic pressure of 10,000 to 30,000 psig. at between 700° C. to 1080° C.; or (iii) containing the blended copper-chromium powder and the additional chromium powder into an evacuated can and hot extruding the can between 400° C. to 900° C., to form the contacts.

36 Claims, 2 Drawing Sheets

VACUUM CIRCUIT INTERRUPTER CONTACTS CONTAINING CHROMIUM DISPERSIONS

TECHNICAL FIELD

This invention relates to vacuum-type circuit interrupters and in particular pertains to the structure of contacts for such a circuit interrupter and to a method for manufacturing the contact structure material suitable for higher voltage withstand capability and improved dielectric strength.

BACKGROUND OF THE INVENTION

It is known that vacuum-type circuit interrupters generally comprise an evacuated insulated envelope with separable contacts disposed within the insulated envelope. The contacts are movable between a closed position of the circuit-interrupter in which the contacts are firmly engaged and in open position of the circuit interrupter where the contacts are separated to establish an arc gap therebetween. Vacuum-type circuit interrupters are disclosed in U.S. Pat. No. 4,419,551 issued Dec. 6, 1983 in which the contacts are formed from a sintered copper-chromium alloy, with chromium dispersed in a copper matrix. Another vacuum-type circuit interrupter is disclosed in U.S. Pat. No. 4,302,514 issued Nov. 24, 1981 to a contact for a vacuum interrupter which is prepared by uniformly distributing, in a copper matrix, two kinds of high melting point metal powders. Other related U.S. Pat. No. 3,818,163 issued June 18, 1974; U.S. Pat. No. 4,032,301 issued June 28, 1977; U.S. Pat. No. 4,008,081 issued February, 1977; U.S. Pat. No. 4,190,753 issued Feb. 26, 1980 U.S. Pat. No. 4,048,117 issued Sept. 13, 1977; and U.S. Pat. No. 3,960,554 issued June 1, 1976 and U.S. Pat. No. 4,323,590 issued Apr. 6, 1982 all disclose various forms of powdered metallurgical processes for forming vacuum circuit interrupter contacts. U.S. Pat. No. 4,259,270 teaches a specific form of rapid solidification of aluminum alloys, completely distinct for copper-chromium sintered material.

It is also known to manufacture sintered contacts for vacuum circuit interrupters by mixing copper powder and chromium powder in various proportions, pressing them, and then sintering the resulting compacted material at a temperature of about 1050° C. or above 1210° C. which is above the melting point of Copper, as in U.S. Pat. No. 3,960,554 issued June 1, 1976 and assigned to the assignee of the present invention.

SUMMARY OF THE INVENTION

The present invention discloses the novel technique of forming copper-chromium contacts for a circuit interrupter, in which the contacts are formed with a relatively low chromium content and finely dispersed within the contact structure and to a process of rapid solidification of the melted mixed metal formed as powder. In this novel process of manufacture of copper-chromium contacts by the application of rapid solidification technology for the production of electrical contact material, the contacts are suitable for high voltage withstand capability and improved dielectric strength.

An object of this invention is to teach a method of manufacturing vacuum interrupter contacts utilizing rapid solidification processing to provide a contact structure that consists of a combination of fine chromium dispersion within the copper grains and a coarse chromium dispersion in the copper matrix.

Further objects of the invention are to provide contacts for vacuum circuit interrupters that enhance dielectric strength and the voltage withstand characteristics and considerably improve the anti-weld capabilities.

BRIEF DESCRIPTION OF THE DRAWINGS

For a better understanding of the invention, the invention will now be described, by way of example, with reference to the accompanying drawings, in which.

In the manufacture of vacuum interrupters, certain components are of considerable importance, for example, interrupter contacts.

Figure 1:
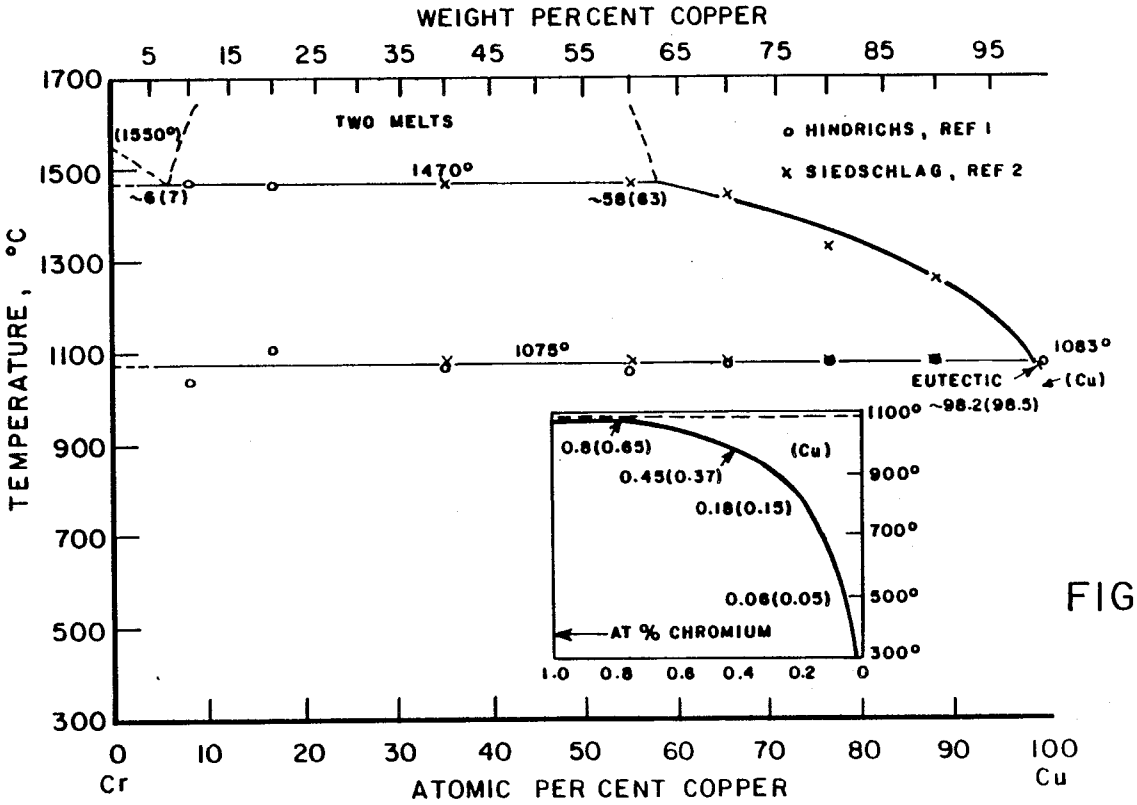
FIG. 1 shows a phase-diagram of copper rich alloys to practice the teaching of the present invention.

In accordance with the present invention, the technique of fabricating the vacuum interrupter contacts, generally performed under vacuum consists of forming a copper rich-copper chromium alloy, by initially adding to copper powder, chromium in powder from, in which the chromium added is between an amount of between two weight percent and thirty-seven weight percent. The mixture is then melted at a temperature of between 1100° C. to 1500° C. When chromium and copper are heated, chromium goes into solution in an amount dependent on the temperature. The binary phase diagram as shown in FIG. 1 shows the copper-chromium relationship in which as the temperature of copper rich melt is raised to above its melting point, the solubility of chromium gradually increases to about twenty-two weight percent at 1400° C. For example, it has been observed that with a copper rich copper chromium alloy, material contact sintered at 1200° C. have about ten times as much dissolved chromium as those sintered at 1050° C. Generally, all or part of this dissolved chromium will remain contained in the final copper chromium alloyed products such as a contact, depending on the rate of cooling.

In another preferred form copper metal is mixed with chromium metal wherein to the copper, chromium is mixed in an amount of between twelve weight percent and thirty-seven weight percent. The mixture is melted at a temperature of between 1200° C. and 1500° C., and then rapidly solidified converting the molten mixture directly into fine particles or in the form of thin ribbons and forming said ribbons into fine powder. Subsequently, cold pressing the blended copper-chromium powder at about 100,000 psig. and vacuum sintering between 800° C. and 1400° C. to form said contact.

In another form, the copper-chromium powder would be subjected to hot isostatic pressure of between 10,000 psig and 30,000 psig at between 700° C. to 1080° C. to form said contacts. In a further preferred form, the blended copper-chromium powder is contained into an evacuated can which is hot extruded at a temperature of between 400° C. to 900° C. to form an extruded bar to fabricate said contacts.

In accordance with the present invention, it is proposed to utilize the increased solubility of chromium in copper with increasing temperature of the melt above the melting point of copper, in which the copper-chromium melt is superheated to the required temperature above 1083° C. and up to about 1400° C. This melt is subsequently converted into powder by rapidly solidifying the melt using any known method that would provide a cooling rate of greater than $10^4$/second in powder particular. This step of the invention may be established by inert gas atomization to produce the prealloyed copper rich chromium alloyed powder directly or by forming thin foils obtained by melt spinning.

Figure 2:
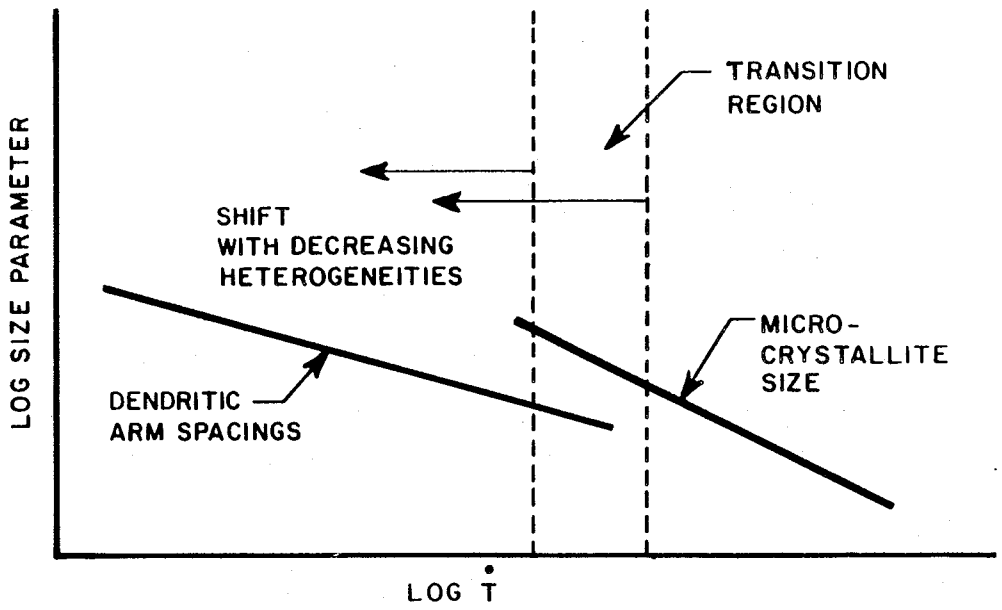
FIG. 2 shows the effect of cooling rate on grain size, particularly on copper rich alloys containing a fine, uniform chromium dispersion.

An alternative step may be to pour the melt into an ingot and pulverize the ingot into powder. The powder obtained from cast ingot is of relatively coarse copper grain and has a higher degree of segregated chromium. This is quite significant as shown in FIG. 2 where chromium is finely dispersed through rapid solidification and the utilization of melt spinning to obtain thin foils for forming into a powder, which is very fine grained alloy powder containing a very fine dispersion of chromium. Advantageously, the dendrite arm spacing, which helps to determine the degree of segregation, diffusion times, etc. is rather small and aids in the subsequent processing based on homogenization sintering times for rapidly solidified powders.

Homogenization-Sintering Times for Rapidly Solidified Powders $$t = \frac{0.12\lambda^2}{D_{Cr}^{Cu}} \text{ for 99\% decay/homogenization}$$

where $\lambda$: dendrite arm spacing (DAS)

$D_{Cr}^{Cu}$: Diffusion coefficient of Cr in Cu at temperature $t \alpha \lambda^2$ for a constant $D_{Cr}$

| DAS | conventional | solidification | Rapid | solidification |
|---|---|---|---|---|
| $\lambda$ $\mu$m | 1000 | 100 | 10 | 1 |
| t $\alpha$ | $10^6$ secs | $10^4$ secs | $10^2$ secs | 10 secs |

The copper rich chromium alloyed powders are then blended with an additional amount of chromium powder of between two weight percent and forty-eight weight percent so as to achieve the desired bulk composition in the contact but not to exceed fifty-five weight percent of chromium in the final contact structure. This blended mixture is then subjected to cold pressing at about 100,000 psig. and vacuum sintered at a temperature of between 800° C. to 1400° C. to form the contact. Alternatively, this blended mixture may be subjected to hot isostatic pressure of between 10,000 psig. to about 30,000 psig. at between 700° C. to 1080° C. for said contacts, or the blended copper chromium mixture with the added chromium powder is then contained into evacuated can. The evacuated can is subsequently hot extruded at a temperature of between 400° C. to 900° C. to form an extruded bar to fabricate and manufacture the contacts from the extruded bar.

In view of the finer dendritic arm spacing, the diffusion time during sintering or the homogenization times during hot isostatic pressing are very low, so that not very little coarsening of the soluble chromium takes place, but in the final product such as a contact the desired densities are acquired.

In another preferred form of contact, the prealloyed admixed copper chromium powder could contain up to about twenty-five percent weight of chromium. Advantageously, the chromium content in the final contact structure being up to twenty-five weight percent.

In some instances, to the prealloyed admixed copper chromium metal or powder having chromium of an amount of between two weight percent and thirty-seven weight percent, there may be added to this mixture less than two percent by weight any one or more of the constituents selected from bismuth; bismuth oxide; chromium oxide and titanium in powder form.

The vacuum interrupter contacts of the present invention has a fine dispersion of chromium present throughout the copper grains. The presence of this fine dispersion produces a uniform dispersion of chromium inside the copper grains which greatly reduces segregation which results in a much less embrittling effect of the contact. This provides the advantage of improved mechanical strength and ductility. Consequently, the contact has also enhanced dielectric strength and a much higher voltage withstand capability, and the problem of contact separation and welding of contacts is reduced. The contact surfaces are formed with a greater degree of smoothness with fewer protuberances. The coarser chromium particles of powder which was blended into the mixture helps to provide the anti-welding ingredient in the contact surface structure.

A further advantage lies in this novel technique of rapid solidification, since chromium exists as a fine uniform dispersion in the copper rich matrix as compared to massive chromium phases obtained by presently known powder metallurgical processes, a lower chromium content is utilized without any reduction in anti-welding properties.

What is claimed is:

1. The method of manufacturing copper chromium electrical contacts for vacuum-type circuit interrupters which method consists of the following steps:
   (a) admixing copper and chromium metals wherein to the copper, chromium is mixed in an amount of between twelve weight percent and thirty-seven weight percent;
   (b) melting the admixed copper and chromium mixture of (a) at a temperature of between 1200° C. and 1500° C.;
   (c) rapidly solidifying the molten mixture directly into five particles or in the form of thin ribbons and forming said ribbons into fine powder;
   (d) cold pressing the copper-chromium powder of step (c) at about 100,000 psig. and vacuum sintering between 800° C. and 1400° C. to form said contact.

2. The method of manufacturing copper-chromium electrical contacts for vacuum-type circuit interrupters which method consists of the following steps:
   (a) admixing copper and chromium metals wherein to the copper, chromium is mixed in an amount of between twelve weight percent and thirty-seven weight percent;
   (b) melting the admixed copper and chromium mixture of (a) at a temperature of between 1200° C. and 1500° C.;
   (c) rapidly solidifying the molten mixture directly into fine particles or in the form of thin ribbons and forming said ribbons into fine powder;
   (d) subjecting the copper-chromium powder of step (c) to hot isostatic pressure of between 10,000 psig. and 30,000 psig. at between 700° C. to 1080° C. to form said contacts.

3. The method of manufacturing copper chromium electrical contacts for vacuum-type circuit interrupters which method consists of the following steps:
   (a) admixing copper and chromium metals wherein to the copper, chromium is mixed in an amount of between twelve weight percent and thirty-seven weight percent;

(b) melting the admixed copper and chromium mixture of (a) at a temperature of between 1200° C. and 1500° C.;

(c) rapidly solidifying the molten mixture directly into fine particles or in the form of thin ribbons and forming said ribbons into fine powder;

(d) containing the blended copper-chromium powder of step (c) into an evacuated can and hot extruding the can at a temperature of between 400° C. to 900° C. to form an extruded bar to fabricate said contacts.

4. The method of manufacturing copper-chromium electrical contacts as set forth in claim 1, wherein in the step (a) of admixing to copper, the chromium comprises about 25 weight percent.

5. The method of manufacturing copper chromium electrical contacts as set forth in claim 2, wherein in the step (a) of admixing to copper, the chromium comprises about 25 weight percent.

6. The method of manufacturing copper-chromium electrical contacts as set forth in claim 3, wherein in the step (a) of admixing to copper, the chromium comprises about 25 weight percent.

7. The method of manufacturing copper-chromium electrical contacts as set forth in claim 1 wherein to the admixed copper-chromium powder of step (c) is added less than 2 percent by weight any one or more of the constituents selected from bismuth; bismuth oxide; chromium oxide and titanium in powder form.

8. The method of manufacturing copper-chromium electrical contacts as set forth in claim 2 wherein to the admixed copper-chromium powder of step (c) is added less than two percent by weight of any one or more of the constituents selected from bismuth; bismuth oxide; chromium oxide and titanium in powder form.

9. The method of manufacturing copper-chromium electrical contacts as set forth in claim 3 wherein to the admixed copper-chromium powder of step (c) is added less than two percent by weight of any one or more of the constituents selected from bismuth; bismuth oxides; chromium oxide and titanium in powder form.

10. A vacuum-type circuit interrupter contact of copper-chromium which exhibits high voltage withstand capability, and has a uniform dispersion of chromium throughout the copper grains, wherein the contact is manufactured by the process consisting of admixing with copper metal, chromium metal in an amount of between 2 weight percent to 37 weight percent; melting the mixture at a temperature of between 1100° C. to 1500° C.; rapidly solidifying the molten mixture directly into fine particles or in the form of thin ribbon and forming said ribbons into fine powder; and cold pressing the copper-chromium powder mixture at about 100,000 psig. and vacuum sintering between 800° C. and 1400° C. to form said contact.

11. A vacuum-type circuit interrupter contact of copper chromium which exhibits high voltage withstand capability, and has a uniform dispersion of chromium throughout the copper grains, wherein the contact is manufactured by the process consisting of admixing with copper metal, chromium metal in an amount of between twelve weight percent and thirty-seven weight percent; melting the mixtures at a temperature of between 1200° C. and 1500° C.; rapidly solidifying the molten mixture directly into fine particles or in the form of thin ribbons and forming said ribbons into fine powder; and subjecting the copper-chromium powder mixture to hot isostatic pressure of between 10,000 psig. and 30,000 psig. at between 700° C. to 1080° C. to form said contact.

12. A vacuum type circuit interrupter contact of copper-chromium which exhibits high voltage withstand capability, and has a uniform dispersion of chromium throughout the copper grains, wherein the contact is manufactured by the process consisting of admixing with copper metal, chromium metal in an amount of between 2 weight percent to 37 weight percent; melting the mixture at a temperature of between 1100° C. to 1500° C.; rapidly solidifying the molten mixture directly into fine particles or in the form of thin ribbons and forming said ribbons into fine powder; introducing the chromium-copper powder into an evacuated can and hot extruding the can at a temperature of between 400° C. to 900° C. to form an extruded bar to form said contact.

13. The circuit interrupter contact as set forth in claim 10, wherein to the initial admixing to copper metal, chromium metal comprises about 25 weight percent.

14. The circuit interrupter contact as set forth in claim 11, wherein to the initial admixing to copper metal, chromium metal comprises about 25 weight percent.

15. The circuit interrupter contact as set forth in claim 11, wherein to the initial admixing to copper metal, chromium metal comprises about 25 weight percent.

16. The circuit interrupter contact as set forth in claim 9, wherein to the initial copper-chromium powder, is added less than two weight percent any one or more of the constituents selected from bismuth; bismuth oxide; chromium oxide; and titanium in powder form.

17. The circuit interrupter contact as set forth in claim 10, wherein to the initial copper-chromium powder; is added less than two weight percent any one or more of the constituents selected from bismuth; bismuth oxide; chromium oxide; and titanium in powder form.

18. The circuit interrupter contact as set forth in claim 11, wherein to the initial copper-chromium powder, is added less than two weight percent any one or more of the constituents selected from bismuth, bismuth oxide; chromium oxide; and titanium in powder form.

19. The method of manufacturing copper-chromium electrical contacts for vacuum-type circuit interrupters which method consists of the following steps:

(a) admixing copper and chromium metals wherein to the copper, chromium is mixed in an amount of between twelve weight percent and thirty-seven weight percent;

(b) melting the admixed copper and chromium mixture of (a) at a temperature of between 1200° C. and 1500° C.;

(c) rapidly solidifying the molten mixture directly into five particles or in the form of thin ribbons and forming said ribbons into fine powder;

(d) blending the copper-chromium powder of step (c) with additional chromium powder of between 2 weight percent and 48 weight percent, but not to exceed fifty-five weight percent in the final contact structure;

(e) cold pressing the copper-chromium powder of step (d) at about 100,000 psig and vacuum sintering between 800° C. and 1400° C. to form said contact.

20. The method of manufacturing copper-chromium electrical contacts for vacuum-type circuit interrupters which method consist of the following steps:

(a) admixing copper and chromium metals wherein to the copper, chromium is mixed in an amount of between twelve weight percent and thirty-seven weight percent;

(b) melting the admixed copper and chromium mixture of (a) at a temperature of between 1200° C. and 1500° C.;

(c) rapidly solidifying the molten mixture directly into fine particles or in the form of thin ribbons and forming said ribbons into fine powder;

(d) Blending the copper chromium powder of step (c) with additional chromium powder of between 2 weight percent and 48 weight percent but not to exceed fifty-five weight percent of chromium in the final contact structure;

(e) subjecting the copper-chromium powder of step (d) to hot isostatic pressure of between 10,000 psig. and 30,000 psig. at between 700° C. to 1080° C. to form said contacts.

21. The method of manufacturing copper chromium electrical contacts for vacuum-type circuit interrupters which method consists of the following steps:

(a) admixing copper and chromium metals wherein to the copper, chromium is mixed in an amount of between twelve weight percent and thirty-seven weight percent;

(b) melting the admixed copper and chromium mixture of (a) at a temperature of between 1200° C. and 1500° C.;

(c) rapidly solidifying the molten mixture directly into fine particles or in the form of thin ribbons and forming said ribbons into fine powder;

(d) blending the copper-chromium powder of step (c) with additional chromium powder of between 2 weight percent and 48 weight percent but not to exceed fifty-five weight percent of chromium in the final content structure;

(e) containing the blended copper-chromium powder of step (d) into an evacuated can and hot extruding the can at a temperature of between 400° C. to 900° C. to form an extruded bar to fabricate said contacts.

22. The method of manufacturing copper-chromium electrical contacts as set forth in claim 19, wherein in the step (a) of admixing to copper, the chromium preferably comprises about 5 weight percent, with a final chromium content of twenty-five weight percent in the final contact structure.

23. The method of manufacturing copper chromium electrical contacts as set forth in claim 20, wherein in the step (a) of admixing to copper, the chromium preferably comprises about 5 weight percent, with a final chromium content of twenty-five weight percent in the final contact structure.

24. The method of manufacturing copper-chromium electrical contacts as set forth in claim 21, wherein in the step (a) of admixing to copper, the chromium preferably comprises about 5 weight percent, with a final chromium conent of twenty-five weight percent in the final contact structure.

25. The method of manufacturing copper-chromium electrical contacts as set forth in claim 19 wherein to the admixed copper-chromium powder of step (d) is added less than 2 percent by weight any one or more of the constituents selected from bismuth; bismuth oxide; chromium oxide and titanium in powder form.

26. The method of manufacturing copper-chromium electrical contacts as set forth in claim 20 wherein to the admixed copper-chromium powder of step (d) is added less than two percent by weight of any one or more of the constituents selected from bismuth; bismuth oxide; chromium oxide and titanium in powder form.

27. The method of manufacturing copper-chromium electrical contacts as set forth in claim 21 wherein to the admixed copper-chromium powder of step (d) is added less than two percent by weight of any one or more of the constituents selected from bismuth; bismuth oxides; chromium oxide and titanium in powder form.

28. A vacuum-type circuit interrupter contact of copper-chromium which exhibits high voltage withstand capability, and has a uniform dispersion of chromium throughout the copper grains, wherein the contact is manufactured by the process consisting of admixing with copper metal, chromium metal in an amount of between 2 weight percent to 37 weight percent; melting the mixture at a temperature of between 1100° C. to 1500° C.; rapidly solidifying the molten mixture directly into fine particles or in the form of thin ribbon and forming said ribbons into fine powder; blending said copper-chromium powder with additional chromium powder weight of between 2 weight percent and 48 weight percent but not to exceed fifty-five weight percent in the final contact structure; and cold pressing the copper-chromium powder mixture at about 100,000 psig. and vacuum sintering between 800° C. and 1400° C. to form said contact.

29. A vacuum-type circuit interrupter contact of copper chromium which exhibits high voltage withstand capability, and has a uniform dispersion of chromium throughout the copper grains, wherein the contact is manufactured by the process consisting of admixing with copper metal, chromium metal in an amount of between twelve weight percent and thirty-seven weight percent; melting the mixtures at a temperature of between 1200° C. and 1500° C.; rapidly solidifying the molten mixture directly into fine particles or in the form of thin ribbons and forming said ribbons into powder; blending said copper-chromium powder with additional chromium powder of between 2 weight percent and 48 weight percent but not to exceed fifty-five weight percent in the final contact structure; and subjecting the copper-chromium powder mixture to hot isostatic pressure of between 10,000 psig. and 30,000 psig. at between 700° C. to 1080° C. to form said contact.

30. A vacuum type circuit interrupter contact of copper-chromium which exhibits high voltage withstand capability, and has a uniform dispersion of chromium throughout the copper grains, wherein the contact is manufactured by the process consisting of admixing with copper metal, chromium metal in an amount of between 2 weight percent to 37 weight percent; melting the mixture at a temperature of between 1100° C. to 1500° C.; rapidly solidifying the molten mixture directly into fine particles or in the form of thin ribbons and forming said ribbons into powder; blending said copper-chromium powder with additional chromium powder of between 2 weight percent and 48 weight percent but not to exceed fifty-five weight percent in the final contact structure; introducing the chromium-copper powder into an evacuated can and hot extruding the can at a temperature of between 400° C. to 900° C. to form an extruded bar to form said contact.

31. The circuit interrupter contact as set forth in claim 28, wherein to the initial admixing to copper metal, chromium preferably comprises about 5 weight percent, with a final chromium content of twenty-five weight percent in the final contact structure.

32. The circuit interrupter contact as set forth in claim 29, wherein to the initial admixing to copper metal, chromium preferably comprises about 5 weight percent, with a final chromium content of twenty-five weight percent in the final contact structure.

33. The circuit interrupter contact as set forth in claim 30, wherein to the initial admixing to copper metal, chromium preferably comprises about 5 weight percent, with a final chromium content of twenty-five weight percent in the final contact structure.

34. The circuit interrupter contact as set forth in claim 28, wherein to the initial copper-chromium powder, is added less than two weight percent any one or more of the constituents selected from bismuth; bismuth oxide; chromium oxide; and titanium in powder form.

35. The circuit interrupter contact as set forth in claim 29, wherein to the initial copper-chromium powder; is added less than two weight percent any one or more of the constituents selected from bismuth; bismuth oxide; chromium oxide; and titanium in powder form.

36. The circuit interrupter contact as set forth in claim 30, wherein to the initial copper-chromium powder, is added less than two weight percent any one or more of the constituents selected from bismuth, bismuth oxide; chromium oxide; and titanium in powder form.

* * * * *